United States Patent [19]

Kawada

[11] Patent Number: 4,815,712

[45] Date of Patent: Mar. 28, 1989

[54] APPARATUS FOR PREVENTING A ONE-SIDED LOWERING OF A JACK MECHANISM INCLUDING JACKS ADAPTED FOR SYNCHRONOUS OPERATION

[75] Inventor: Hiroyuki Kawada, Hekinan, Japan

[73] Assignee: Sugiyasu Industries Co., Ltd., Takahama, Japan

[21] Appl. No.: 149,123

[22] Filed: Jan. 27, 1988

[30] Foreign Application Priority Data

Jul. 23, 1987 [JP] Japan ..... 62-113179[U]

[51] Int. Cl.[4] ..... B66F 3/00

[52] U.S. Cl. ..... 254/89 H; 254/122; 187/8.5

[58] Field of Search ..... 254/8 R, 8 B, 8 C, 89 H, 254/93 R, 93 H, 122; 187/8.47, 8.49, 8.50

[56] References Cited

U.S. PATENT DOCUMENTS

| | | | |
|---|---|---|---|
| 2,201,179 | 5/1940 | Jackson et al. | 187/8.5 |
| 2,611,579 | 9/1952 | Guzey et al. | 254/8 B |
| 4,328,951 | 5/1982 | Laupper | 254/89 H |

*Primary Examiner*—Robert C. Watson

*Attorney, Agent, or Firm*—Lahive & Cockfield

[57] ABSTRACT

A safety device which prevents any one-sided lowering motion of a jacking system including a plurality of jacks which are designed for simultaneous operation, and a mechanism connecting the jacks for their simultaneous operation. Each jack includes a first hydraulic or pneumatic cylinder for raising and lowering a table, a substantially vertically disposed rack mechanism, a pawl mechanism which is normally engaged with the rack mechanism to hold the table in a raised position, and a second pneumatic or hydraulic cylinder for disengaging the pawl mechanism from the rack mechanism. The safety device includes a plurality of valves each provided in one of the jacks and operable by a pushbutton to produce a fluid presure signal when the pushbutton has been depressed. A mechanical actuator is provided in each jack for depressing the pushbutton when the pawl mechanism has been disengaged from the rack mechanism. An electrical control circuit for the first cylinder includes at least one pressure switch which is operable in response to the signal for allowing the first cylinder to lower the table only when the pawl mechanisms in all of the jacks have been disengaged from the rack mechanisms.

10 Claims, 4 Drawing Sheets

APPARATUS FOR PREVENTING A ONE-SIDED LOWERING OF A JACK MECHANISM INCLUDING JACKS ADAPTED FOR SYNCHRONOUS OPERATION

BACKGROUND OF THE INVENTION

1. Field of the Invention

This invention relates to an apparatus for preventing the one-sided lowering of a jacking mechanism including a plurality of jacks which are designed for simultaneous operation.

2. Description of the Prior Art

There is known a jacking mechanism including a plurality of jacks which are designed for simultaneous operation. It is widely used as, for example, a cargo handling device, or a device for lifting a motor vehicle when repairing it. A typical device of this type comprises a pair of jacks which are connected to each other by a device for raising and lowering the two jacks simultaneously. It also includes a horizontal table or tables provided on the jacks for carrying a load thereon. Each jack is provided with a substantially vertically disposed rack and a pawl which is engageable with the rack for holding the table in its raised position. The pawls are disengaged from the racks when it is necessary to lower the table or tables.

If any attepmt is made to lower the table or tables before the pawl of one of the jacks is disengaged from the rack, however, the jack stays in its raised position, while the other jack is lowered. This results in the inclination of the table or the positioning of the two tables at different levels of height and thereby in the inclination, displacement or dropping of the load on or off the table or tables. In any such event, the load is likely to cause a hazard to the jack operator.

Various kinds of safety devices are, therefore, known. They include a device which detects the position of the tables or tables and transmits a signal for actuating the device for lowering the table or tables only when the table is not inclined, or when the tables stay at the same level of height. This device is, however, complicated and sophisticated. It is expensive and adds considerably to the cost of the jacking device as a whole.

There is also known a device including a limit switch which functions to actuate the device for lowering the table or tables only when the pawls are disengaged from the racks. The device of this type which is now available, however, lacks reliability, as the terminals of the limit switch often fail to make proper contact, or as a limit switch actuator often fails to work properly. Moreover, it is necessary to use an explosion-proof device to prevent any fire from starting in a place where combusttible gas exist, or vapor of combustible liquid is likely to occur. It is expensive and adds undesirably to the cost of the jacking device as a whole.

SUMMARY OF THE INVENTION

Under these circumstances, it is an object of this invention to provide an improved safety device for a jacking system which permits only the simultaneous operation of all of a plurality of jacks constituting the jacking system and thereby prevents any one-sided lowering motion of the system.

This object is attained by a safety device for a jacking system including a plurality of jacks which are designed for simultaneous operation, and a mechanism connecting the jacks for their simultaneous operation, each of the jacks including a first fluid pressure cylinder for raising and lowering a load lifting table, a substantially vertically disposed rack mechanism, a pawl mechanism which is normally held in engagement with the rack mechanism to hold the table in a raised position, and a second fluid pressure cylinder for disengaging the pawl mechanism from the rack mechanism, characterized in that it comprises a plurality of valves each provided in one of the jacks for operation by a pushbutton to transmit a fluid pressure signal when the pushbutton has been depressed, a mechanical actuator provided in each of the jacks for depressing the pushbutton when the pawl mechanism has been disengaged from the rack mechanism, and at least one pressure switch provided in an electrical control circuit for the first cylinder and operable in response to the signal for allowing the first cylinder to lower the table only when the pawl mechanisms in all of the jacks have been disengaged from the rack mechanisms.

The safety device of this invention permits the downward motion of the jacks, thereby allowing the table to be lowered, only when all of the pawl mechanisms have been disengaged from the rack mechanisms. If the pawl mechanism in any of the jacks is not disengaged from the rack mechanism, the corresponding actuator does not depress the pushbutton, and the corresponding valve does not transmit any fluid pressure signal to the pressure switch. Therefore, the pressure switch does not work to actuate any cylinder for lowering the table.

Thus, the device prevents any one-sided lowering motion of the jacking system resulting in the inclination of the table, or if the system includes a plurality of tables, in the positioning of the tables at different levels of height. Therefore, it prevents the displacement or dropping of any cargo on or off the table and thereby protects the jack operator from any safety hazard and the cargo from any damage.

Each of the cylinders is of the type which is operable by a fluid pressure, i.e., either a hydraulic or a pneumatic cylinder.

The fluid pressure signal is an indication of any change that occurs to the flow of a fluid through the valve or its pressure when its pushbutton has been depressed. The flow of the fluid through the valve depends on its construction and may either start or stop when the pushbutton has been depressed.

Other features and advantages of this invention will become apparent from the following description and the accompanying drawings.

DETAILED DESCRIPTION OF THE INVENTION

Figure 1:
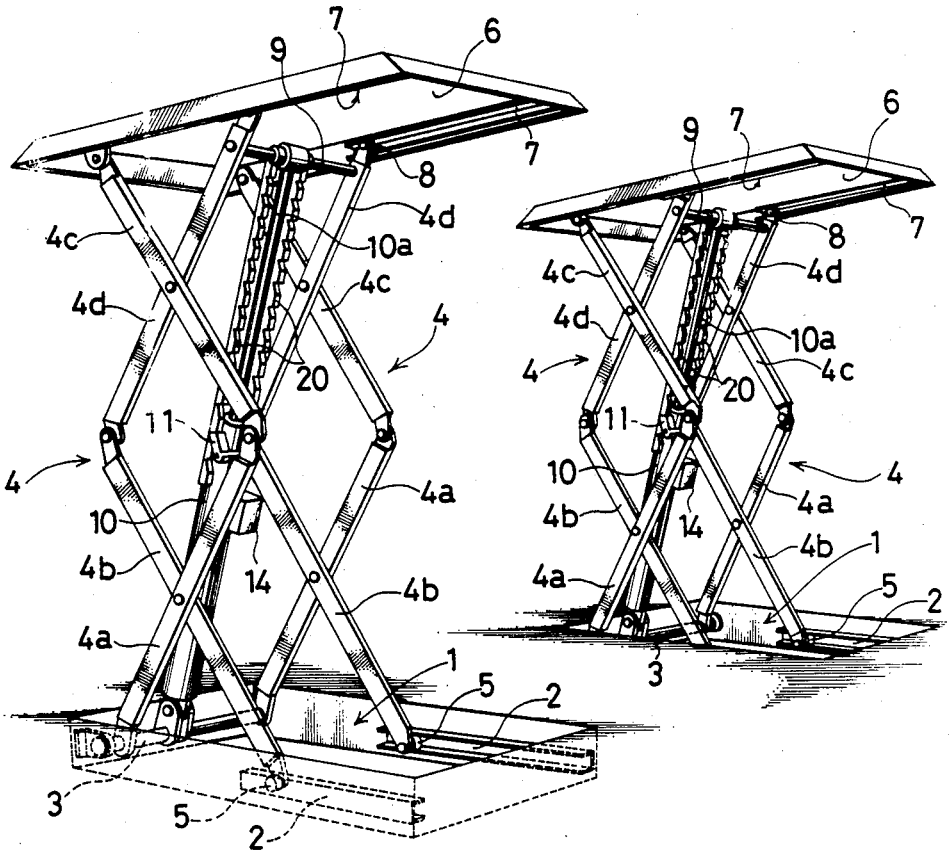
FIG. 1 is a perspective view of a vehicle lifting system including safety device embodying this invention.

A safety device for a jacking system embodying this invention is shown by way of example in FIGS. 1 to 4, 5*a* and 5*b*. More specifically, FIG. 1 shows a jacking system which is used for lifting a motor vehicle when repairing it. The system comprises a pair of jacks which are mounted in a pair of rectangular pits 1, respectively, made in a floor. A pair of channel-shaped rails 2 are provided on two sidewalls, respectively, of each pit 1 and extend from one end of the pit 1 to its middle portion. The open sides of the rails 2 face each other. A pair of coaxial shafts 3 are provided at the other end of each pit 1. Each jack is of the type which is known as a scissors jack. It comprises a pair of double X-shaped jack components 4 disposed vertically in parallel to each other. Each jack component 4 comprises a first link 4*a* and a second link 4*b* which are rotatably joined to each other in their mid-portions and form an X-shaped structure, and a third link 4*c* and a fourth link 4*d* which are also rotatably joined to each other in their mid-portions and form an X-shaped structure. The lower ends of the third and fourth links 4*c* and 4*d* are rotatably connected to the upper ends of the first and second links 4*a* and 4*b*, respectively, whereby a double X-shaped structure is formed. The first link 4*a* in each jack component 4 has a lower end connected rotatably to one of the shafts 3. The second link 4*b* has a lower end provided with a roller 5 fitted in one of the rails 2. The lower end of the second link 4*b* is, therefore, slidable along the rail 2 toward and away from the lower end of the first link 4*a* to thereby cause the jack component 4 to expand and contract.

A table 6, which is adapted for carrying thereon the motor vehicle to be repaired, is horizontally supported on the upper ends of the jack components 4. The upper ends of the third links 4*c* are rotatably supported on the underside of the table 6 at one end thereof. The table 6 is provided on the underside thereof with a pair of transversely spaced apart rails 7 of the channel-shaped construction extending from the other end of the table 6 to its middle portion. Each fourth link 4*d* is provided at the upper end thereof with a roller 8 fitted in one of the rails 7. A connecting rod 9 extends horizontally between the two fourth links 4*d* slightly below the upper ends thereof to connect the fourth links 4*d* and thereby the two jack components 4 together.

A hydraulic cylinder 10 is provided for raising and lowering the table 6. It has a lower end supported rotatably on the shafts 3 and includes a piston rod 10*a* having an upper end supported rotatably on the connecting rod 9 in its middle portion. It is alternatively possible to use a pneumatic cylinder for raising and lowering the table 6.

A pawl mechanism is provided on the cylinder 10 adjacent to the upper end thereof. It comprises a pair of transversely spaced apart pawls 11 supported rotatably on the cylinder 10 and connected to each other by a connecting member 12. A rack mechanism is provided in parallel to the cylinder 10. It comprises a pair of transversely spaced apart parallel racks 20 between which the piston rod 10*a* is disposed. Each rack 20 has a plurality of teeth each having a downwardly facing flank. Each pawl 11 is engageable with one of the racks 20. A coil spring 13 is connected to the pawl connecting member 12 for urging the pawls 11 into engagement with the racks 20. A fluid pressure cylinder or a solenoid can, however, be substituted for the spring 13. The spring 13 is a tension spring.

A hook 16 is fastened to the connecting member 12 on the opposite side thereof from the spring 13. A double-acting pneumatic cylinder 14 includes a piston rod connected to the hook 16 by a knuckle joint 15. The cylinder 14 is provided for disengaging the pawls 11 from the racks 20. A member 17 is provided between the cylinder 14 and the knuckle joint 15 for preventing the rotation of the piston rod. A limit dog 18 is provided below the knuckle joint 15 and defines a mechanical pushbutton actuator. A hydraulic cylinder can be substituted for the pneumatic cylinder 14.

A valve 19 is provided beside the cylinder 14 and includes a pushbutton 19*b*. The valve 19 is so spaced apart from the limit dog 18 that the limit dog 18 abuts on the pushbutton 19*b* to depress it when the piston rod has been retracted to its innermost position in the cylinder 14 and has pulled down the knuckle joint 15 and the hook 16 until the pawls 11 are rotated for disengagement from the racks 20.

Figure 5B:
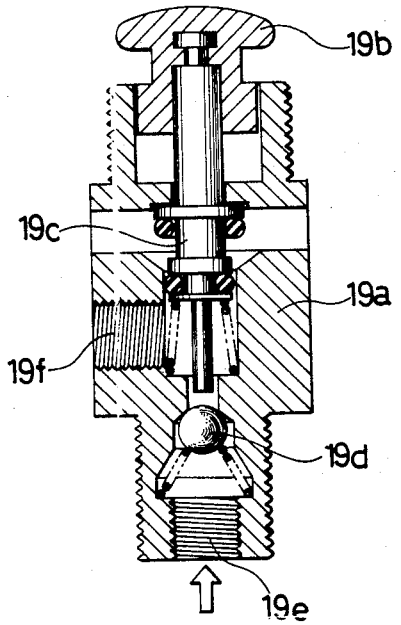
FIG. 5*b* is a view similar to FIG. 5*a*, but showing the valve in its normal position.
Figure 5A:
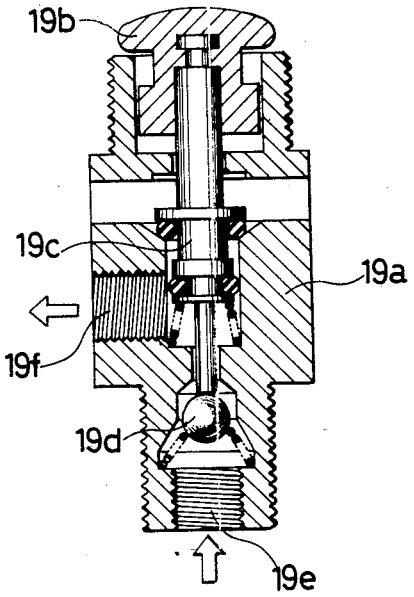
FIG. 5*a* is a front elevational view in section, of a valve including a pushbutton which has been depressed.

The valve 19 comprises a housing 19*a*, the pushbutton 19*b*, a shank 19*c*, and a valve member 19*d* in the form of a ball supported on a spring, as shown in FIGS. 5*a* and 5*b*. The housing 19*a* has at its bottom an air inlet port 19*e* which is normally closed by the ball 19*d*, as shown in FIG. 5*b*, so that no air coming from a change-over valve 21 is allowed to flow through the valve 19 and leave it through an outlet port 19*f*. If the pushbutton 9*b* is depressed, however, the shank 19*c* is moved down and pushes down the ball 19*d* to open the inlet port 19*e*, whereupon air flows through the valve 19 and eventually enters the inlet port of another valve 19.

The pawls 11 are normally held in engagement with the racks 20 by the spring 13, as hereinbefore stated. If the hydraulic cylinder 10 is actuated to raise the table 6, the racks 20 are moved upward and each pawl 11 drops from one tooth to another on the corresponding rack 20, while maintaining its engagement with the rack 20. When the table 6 has been stopped in a raised position, therefore, the pawls 11 cooperate with the racks 20 to hold the table 6 in that position. The pawls 11 can be disengaged from the racks 20 if the pneumatic cylinder 14 is actuated to rotate the pawls 11 clockwise as viewed in FIG. 2 by overcoming the force of the spring 13.

The two pits 1 have an appropriate distance therebetween and are parallel to each other. The two jacks are identical to each other in construction. They are connected to each other by a mechanism which enables them to work simultaneously. It may, for example, comprise a hydraulic fluid conduit connecting the two hydraulic cylinders 10, or a mechanical device including a common shaft.

Figure 3:
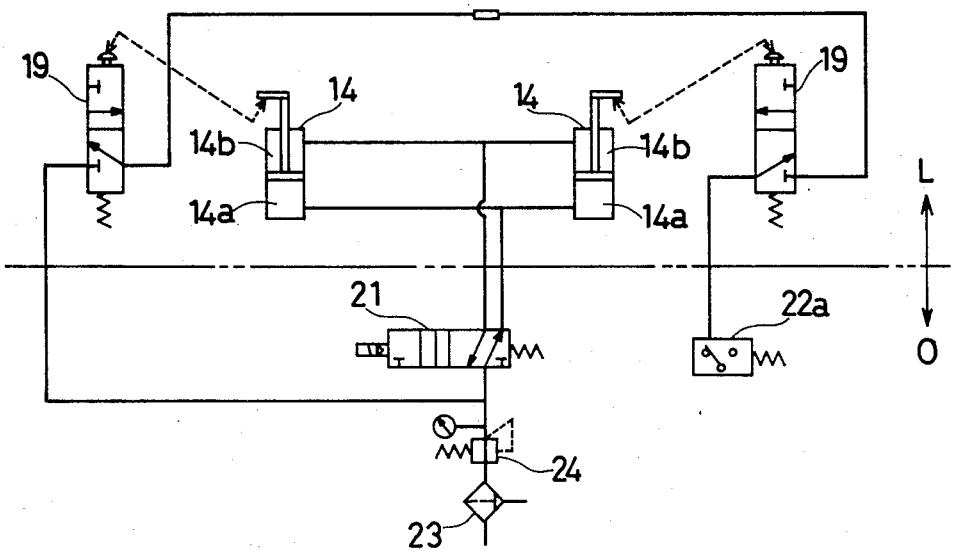
FIG. 3 is a diagram showing a pneumatic control circuit for the safety device.
Figure 4:
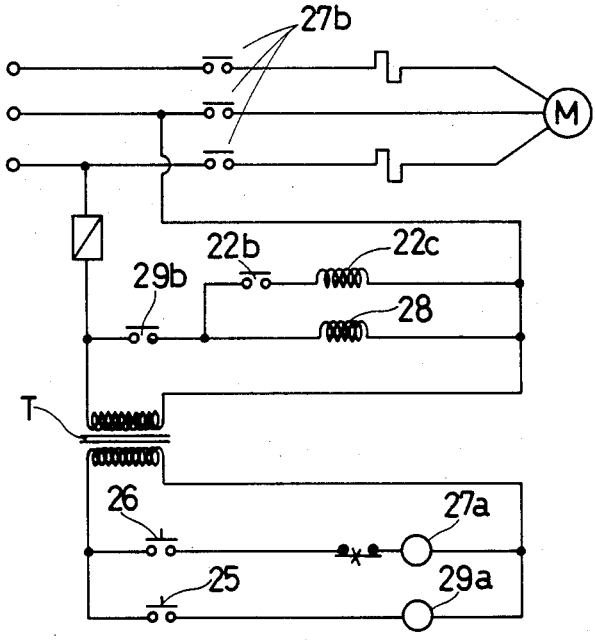
FIG. 4 is a diagram showing an electrical control circuit for the safety device.

Reference is now made to FIG. 3 showing a pneumatic control circuit for the safety device according to this invention and FIG. 4 showing an electrical control circuit therefor. The electrical control circuit includes an electric motor M which is driven by a power source supplying a three-phase power of 200 V. The motor M is controlled by a control circuit which is driven by the same power source, and by a control circuit which is supplied with a voltage of 24 V obtained in a transformer T by dropping the voltage of 200 V. A table raising relay 27*a* is connected in series to a table raising pushbutton switch 26. If the switch 26 is depressed, the coil of the relay 27*a* is energized and its contact 27*b* is, therefore, closed to allow the supply of power to the motor M. As a result, the motor M is rotated to drive a hydraulic pump not shown to supply a hydraulic fluid to the hydraulic cylinders 10 to thereby raise the tables 6.

The changeover valve 21 includes a solenoid 28 provided in the control circuit which is driven by a voltage of 200 V from the power source. A table lowering relay 29*a* has a contact 29*b* to which the solenoid 28 is connected in series. A table lowering valve not shown includes a solenoid 22*c* and a pressure switch 22*a* has a contact 22*b* to which the solenoid 22*c* is connected in series. The contact 22*b* is, in turn, connected in series to the contact 29*b* of the relay 29*a*.

When the pawls 11 stay in engagement with the racks 20, air flows through a filter 23 and a pressure control valve 24 in which its pressure is regulated to a level of 5 kg/cm$^2$, and actuates the changeover valve 21, so that it may flow into the lower chamber 14*a* of the pneumatic cylinder 14 which is located on the opposite side of the piston from the piston rod.

The pawls 11 can be disengaged from the racks 20 if a table lowering pushbutton switch 25 is depressed. If the switch 25 is depressed, an AC voltage of 24 V is applied to the coil of the relay 29*a* and its contact 29*b* is closed to allow the supply of power to the solenoid 28. The changeover valve 21 is actuated to allow air to flow into the upper chamber of the pneumatic cylinder 14 in which the piston rod is located, so that the piston rod may be retracted to its innermost position and cause the hook 16 to rotate the pawls 11 away from engagement with the racks 20. Simultaneously with the disengagement of the pawls 11 from the racks 20, the limit dog 18 abuts on the pushbutton 19*b* of the valve 19 and thereby opens it, whereby air is supplied through the valve 19 to the pressure switch 22*a*. If the air reaches a pressure of 4 kg/cm$^2$ as set by the pressure switch 22*a*, its contact 22*b* is closed to allow the supply of power to the solenoid 22*c*. As a result, the table lowering valve is actuated to reduce the pressure of the hydraulic fluid in the hydraulic cylinders 10 and thereby allow the tables 6 to be lowered.

As is obvious from the foregoing description, it is the pressure of the air and the mechanical devices that control the whole operation after the air has flown into the upper chamber 14*b* of the double-acting pneumatic cylinder 14 and until the pressure switch 22*a* is actuated.

If the pawls in either of the jacks are not disengaged from the racks when it is necessary to lower the tables 6, the piston rod of the pneumatic cylinder 14 in that jack fails to be retracted to its innermost position and the limit dog 18, therefore, fails to abut on the pushbutton 19*b* of the valve 19, resulting in the failure of the valve 19 to open and thereby supply air to the pressure switch 22*a*. The contact 22*b* of the pressure switch 22*a* remains open and the solenoid 22*c* cannot be energized to cause the tables 6 to be lowered.

Although each of the valves 19 has been described as being of the type which is normally closed and opens when its pushbutton is depressed, it is alternatively possible to use a valve of the type which is normally open and closes when its pushbutton is depressed. Both of these types of valves are equally effective as means for producing a signal indicating that the pawls have been properly disengaged from the racks.

Although the pushbutton-operated valves have been described as being connected in series to each other and to a common pressure switch, it is alternatively possible to provide a plurality of pressure switches each for one of the valves and connect the contacts of the pressure switches in series to each other.

Although the disengagement of the pawls from the racks has been described as being effected by the double-acting pneumatic cylinders and the pushbutton-operated valves have been described as employing air as a medium for producing a signal to the pressure switch, it is alternatively possible to use hydraulic cylinders and a hydraulic fluid for those purposes, respectively.

Figure 2:
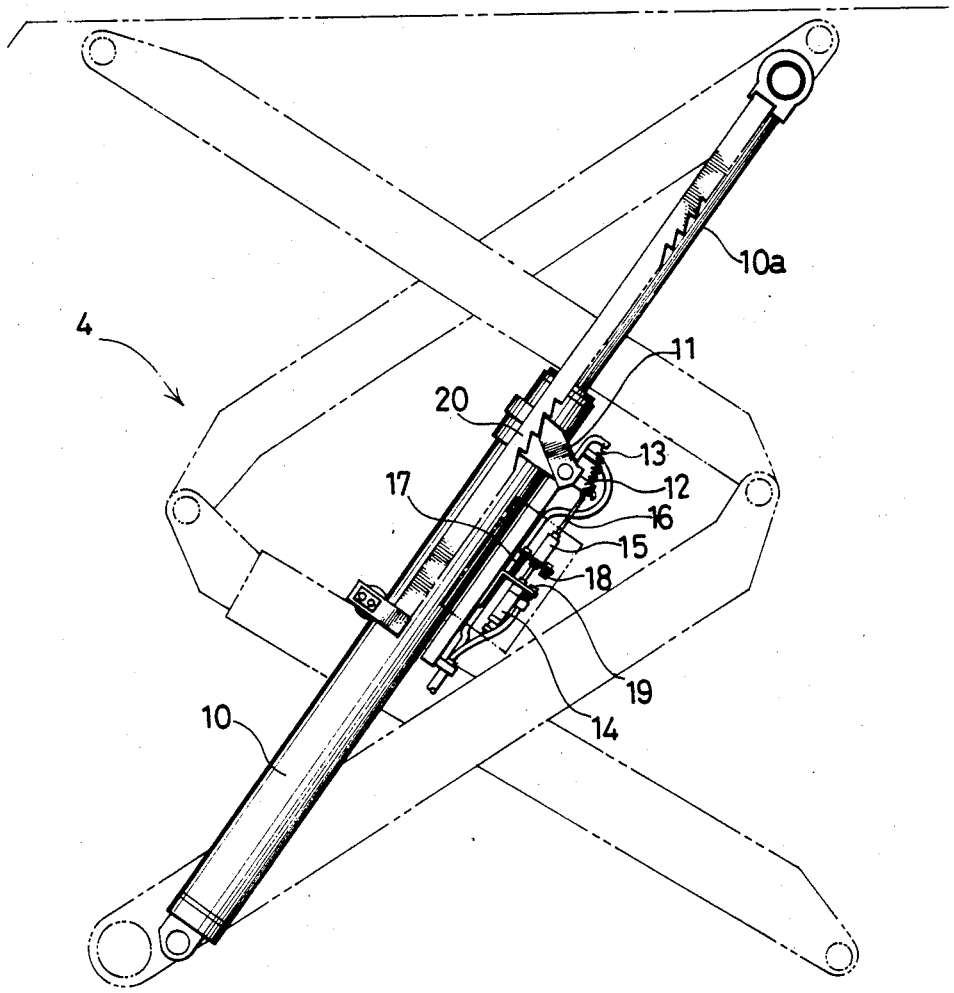
FIG. 2 is a fragmentary enlarged front elevational view of the safety device.
Figure 6:
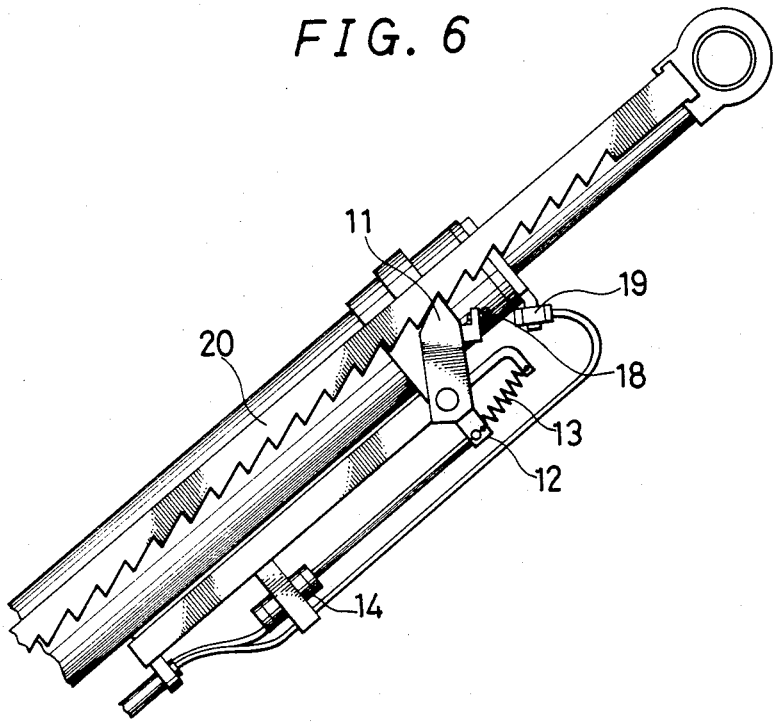
FIG. 6 is a view similar to a part of FIG. 2, but showing a different embodiment of this invention.

Although the signal transmitting arrangement has been described as being constructed as shown in FIG. 2, it is also possible to employ any other arrangement if the pushbutton-operated valves can be properly operated when the pawls have been disengaged from the racks. An alternative arrangement is shown by way of example in FIG. 6. The arrangement of FIG. 6 is characterized in that the piston rod of the double-acting pneumatic cylinder 14 is directly connected to the pawl connecting member 12, that the limit dog 18 is provided on the pawl 11, and that the valve 19 on which the limit dog 18 can abut is also located differently from its counterpart in FIG. 2.

Although the invention has been described with reference to a vehicle lifting system including jack components of the double X-shaped construction, it is equally applicable to a wide variety of other systems including a plurality of jacks designed for simultaneous operation and a pawl and rack arrangement of the character as hereinabove described. More specifically, it is, for example, applicable to not only a vehicle lifting system including jack components of the single X-shaped construction, but also a vehicle lifting system of the type mounted below the floor level, an arch-shaped vehicle lifting system, and a vehicle lifting system of the two- or four-post type.

Referring to FIG. 3 again, the central broken line divides the lifting system proper L in which the fluid pressure-operated components are provided, from the hydraulic unit 0 associated with the electrical control circuit and connected to the lifting system proper L by the air piping. The hydraulic unit Oand the other equipment associated therewith are located outside the area in which combustible gas is likely to exist or vapor of combustible liquid is likely to occur, and do, therefore, not need to be of the explosion-proof type. They can, of course, be located in the area in which the lifting system proper L is installed, though in that event, they may need to be of the explosion-proof type. In either event, the jacking system including the device of this invention is always operable without causing any safety hazard to the operator or any damage to the cargo being handled.

What is claimed is:

1. In a safety device for a jacking system including a plurality of jacks which are designed for simultaneous operation, and a mechanism connecting said jacks for their simultaneous operation, each of said jacks including a first fluid pressure cylinder for raising and lowering a table, a substantially vertically disposed rack mechanism, a pawl mechanism which is normally engaged with said rack mechanism to hold said table in a raised position, and a second fluid pressure cylinder for disengaging said pawl mechanism from said rack mechanism, the improvement which comprises:

a plurality of valves each provided in one of said jacks and operable by a pushbutton to transmit a fluid pressure signal when said pushbutton has been depressed; pressed;

a mechanical actuator provided in each of said jacks for depressing said pushbutton when said pawl mechanism has been disengaged from said rack mechanism; and an electrical control circuit for said first cylinder including at least one pressure switch which is operable in response to said signal for allowing said first cylinder to lower said table only when said pawl mechanisms in all of said jacks have been disengaged from said rack mechanisms.

2. A safety device as set forth in claim 1, wherein said second cylinder includes a piston rod on which said mechanical actuator is provided.

3. A safety device as set forth in claim 1, wherein said mechanical actuator is provided on said pawl mechanism.

4. A safety device as set forth in claim 3, wherein said valves are provided in a fluid pressure line in which they are connected in series to each other, and said lien has a terminal to which said pressure switch is connected in series.

5. A safety device as set forth in claim 3, wherein at least one pressure switch consists of a plurality of pressure switches each provided for one of said valves, said pressure switches having contacts connected in series to each other in said electrical control circuit.

6. A safety device as set forth claim 3, wherein said first cylinder is a hydraulic cylinder, while said second cylinder is a double-acting pneumatic cylinder.

7. A safety device as set forth in claim 6, wherein said signal is formed by a change in the flow of air through each of said valves.

8. A safety device as set forth in claim 7, wherein each of said valves is of the type which opens to produce said signal when said pushbutton has been depressed.

9. A safety device as set forth in claim 8, wherein each of said valves comprises a housing having an inlet port and an outlet port, a valve member disposed in an air passage between said inlet and outlet ports and normally closing said passage, and a shank on which said pushbutton is provided, said shank being coaxial with said valve member and engageable therewith to open said passage when said pushbutton is depressed, said outlet port leading to said pressure switch.

10. A safety device as set forth in claim 9, wherein said rack mechanism comprises a pair of parallel racks extending along said first cylinder, and said pawl mechanism comprises a pair of pawls of which each is normally engaged with one of said racks, and which are connected by a member to which said second cylinder is connected.

* * * * *

UNITED STATES PATENT AND TRADEMARK OFFICE

CERTIFICATE OF CORRECTION

PATENT NO. : 4,815,712

DATED : 28 March 1989

INVENTOR(S) : Hiroyuki Kawada

It is certified that error appears in the above-identified patent and that said Letters Patent is hereby corrected as shown below:

Column 1, line 39, replace "tables or tables" with --table or tables--.

Column 2, line 63, replace "view in section," with --view, partly in section,--.

Column 6, line 68, delete "pressed;".

Column 7, line 20, replace "lien" with --line--.

Signed and Sealed this

Twenty-fourth Day of April, 1990

*Attest:*

HARRY F. MANBECK, JR.

*Attesting Officer*

*Commissioner of Patents and Trademarks*